US007546184B2

(12) United States Patent
Meltser et al.

(10) Patent No.: US 7,546,184 B2
(45) Date of Patent: Jun. 9, 2009

(54) LOCOMOTIVE ENGINE RESTART SHUTDOWN OVERRIDE SYSTEM AND METHOD

(75) Inventors: Mikhail Meltser, Buffalo Grove, IL (US); David Mark Taccone, Erie, PA (US); Bhupinder Singh Dayal, Fairview, PA (US); David E. Petersen, Erie, PA (US)

(73) Assignee: General Electric Company, Schenectady, NY (US)

( * ) Notice: Subject to any disclaimer, the term of this patent is extended or adjusted under 35 U.S.C. 154(b) by 949 days.

(21) Appl. No.: 10/878,758

(22) Filed: Jun. 28, 2004

(65) Prior Publication Data

US 2005/0027411 A1 Feb. 3, 2005

Related U.S. Application Data

(60) Provisional application No. 60/490,624, filed on Jul. 28, 2003.

(51) Int. Cl.
*F02N 17/00* (2006.01)
*F02N 9/00* (2006.01)
*F02B 77/14* (2006.01)

(52) U.S. Cl. ..... 701/19; 123/179.3; 123/179.4; 123/196 C; 417/62; 417/213

(58) Field of Classification Search ..... 701/19, 701/113, 36, 114, 99; 123/491, 685, 41.14, 123/41.44–41.47, 41.01, 179.3, 179.4, 198 C, 123/41.1; 417/62, 213, 280, 286, 316, 364
See application file for complete search history.

(56) References Cited

U.S. PATENT DOCUMENTS

| | | | | | |
|---|---|---|---|---|---|
| 4,450,801 | A | * | 5/1984 | Thedens et al. | 123/198 F |
| 4,729,355 | A | * | 3/1988 | Barnes | 123/342 |
| 4,911,121 | A | * | 3/1990 | Barnes | 123/198 D |
| 5,036,803 | A | * | 8/1991 | Nolting et al. | 123/41.1 |
| 5,265,567 | A | * | 11/1993 | Nudds et al. | 123/198 D |

FOREIGN PATENT DOCUMENTS

| | | |
|---|---|---|
| DE | 37 38 412 A1 | 5/1989 |
| DE | 39 29 078 A1 | 3/1991 |
| DE | 195 00 445 A1 | 7/1996 |
| EP | 1 270 935 A2 | 1/2003 |

OTHER PUBLICATIONS

International Search Report for Application No. PCT/US2004/022620, dated Oct. 26, 2004, 7 pages.

* cited by examiner

*Primary Examiner*—Thomas G Black
*Assistant Examiner*—Christine M Behncke
(74) *Attorney, Agent, or Firm*—Senniger Powers LLP

(57) ABSTRACT

A system for overriding an EMD locomotive engine protective device which includes a low water pressure sensing device in communication with the engine cooling system for shutting down the engine when low water pressure in the engine is sensed, the override system comprising a water assist pump connected to a source of water and communicating with the protective device for supplying pressurized water to the low water pressure sensing device to maintain relatively high water pressure to prevent the device from shutting down the engine; and a controller for activating the water assist pump during start up of the engine.

10 Claims, 6 Drawing Sheets

LOCOMOTIVE ENGINE RESTART SHUTDOWN OVERRIDE SYSTEM AND METHOD

CROSS REFERENCE TO RELATED APPLICATIONS

The invention of the present application claims priority based on U.S. Provisional Application Ser. No. 60/490,624 filed on Jul. 28, 2003.

BACKGROUND OF THE INVENTION

This invention relates to EMD locomotive engine protection devices and more particularly to preventing conditions causing the trip of the device in an EMD locomotive engine during a computer controlled automatic engine restart.

Railway locomotives are off service for substantial periods of time and are generally shut down when they are not going to be in use for extended time periods. Since some locomotive systems may be harmed if the engine is shut down for too long, there are automated systems designed to stop and restart an engine automatically in the absence of personnel. Whether an engine is being started automatically or manually there are engine protective devices designed to sense certain conditions in an engine's systems during start up and running which will shut an engine down under certain conditions. Unfortunately, and especially after an EMD locomotive engine has been shut down for a long period of time, transient conditions on start-up may be sensed by such protective devices and result in the engine being immediately shut down again. This condition defeats the advantage of an automatic engine start/stop system (AESS) and may require the need for personnel to be available to restart such an engine by overriding the protective devices.

One protective device for engines manufactured by the Electro-Motive Division of General Motors (EMD) is a differential water and crankcase pressure detector system. This device monitors for abnormalities in the engine cooling system and crankcase pressure. If potentially harmful abnormalities are sensed the engine is shut down. Sometimes sensed abnormalities at engine start-up due to transient conditions, such as low coolant system pressure, cause this protective device to produce an unnecessary engine shutdown. In these EMD protective devices of Electro-Motive Division of General Motors locomotive engines there are manual resets which require the presence of qualified personnel to restart the engine, thus often defeating the advantage of an AESS system on such engines.

SUMMARY OF THE INVENTION

The present invention overcomes the above-described disadvantages and difficulties associated with EMD engine protective devices by providing systems and methods which temporarily inhibit their function on engine start-up while utilizing an AESS system.

One aspect of the present invention provides a system for overriding an EMD locomotive engine protective device which includes a low water pressure sensing device in communication with the engine cooling system for shutting down the engine when low water pressure in the engine is sensed, the override system comprising a water assist pump connected to a source of water and communicating with the protective device for supplying pressurized water to the low water pressure sensing device to maintain relatively high water pressure to prevent the device from shutting down the engine; and a controller for activating the water assist pump during start up of the engine. The controller preferably operates the water assist pump during priming and cranking of the engine and can be used in conjunction with an AESS system.

A further aspect of the present invention provides a system for overriding an EMD locomotive engine protective device which includes first and second interconnected diaphragms, one side of the first diaphragm in communication with a discharge from an engine water pump and an opposite side of the first diaphragm in communication with an inlet of the engine water pump and a first side of the second diaphragm in communication with an engine air box such that the diaphragms are moved by differential pressure across the diaphragms when the differential pressure across the first diaphragm becomes less than the pressure of the engine's air pressure box acting on the second diaphragm, indicating low water pressure in a cooling system of an EMD locomotive engine, the override system comprising a water assist pump connected to a source of water and communicating with the protective device for supplying pressurized water to the one side of the first diaphragm in the engine protective device; and a controller for activating the water assist pump during start up of the engine.

Another aspect of the present invention includes a method of overriding an EMD locomotive engine protective device which includes a low water pressure sensing device in communication with the engine cooling system for shutting down the engine when low water pressure in the engine is sensed, the override method comprising activating a water assist pump in communication with the engine cooling system during engine start-up to supply water pressure to the protective device such that the protective device will not shut down the engine. This aspect also preferably includes the step wherein the water assist pump is operated during priming and cranking of the engine. This method also preferably includes the activating step being used in conjunction with an automatic engine start/stop system activation.

DETAILED DESCRIPTION OF THE PREFERRED EMBODIMENT

Figure 1:
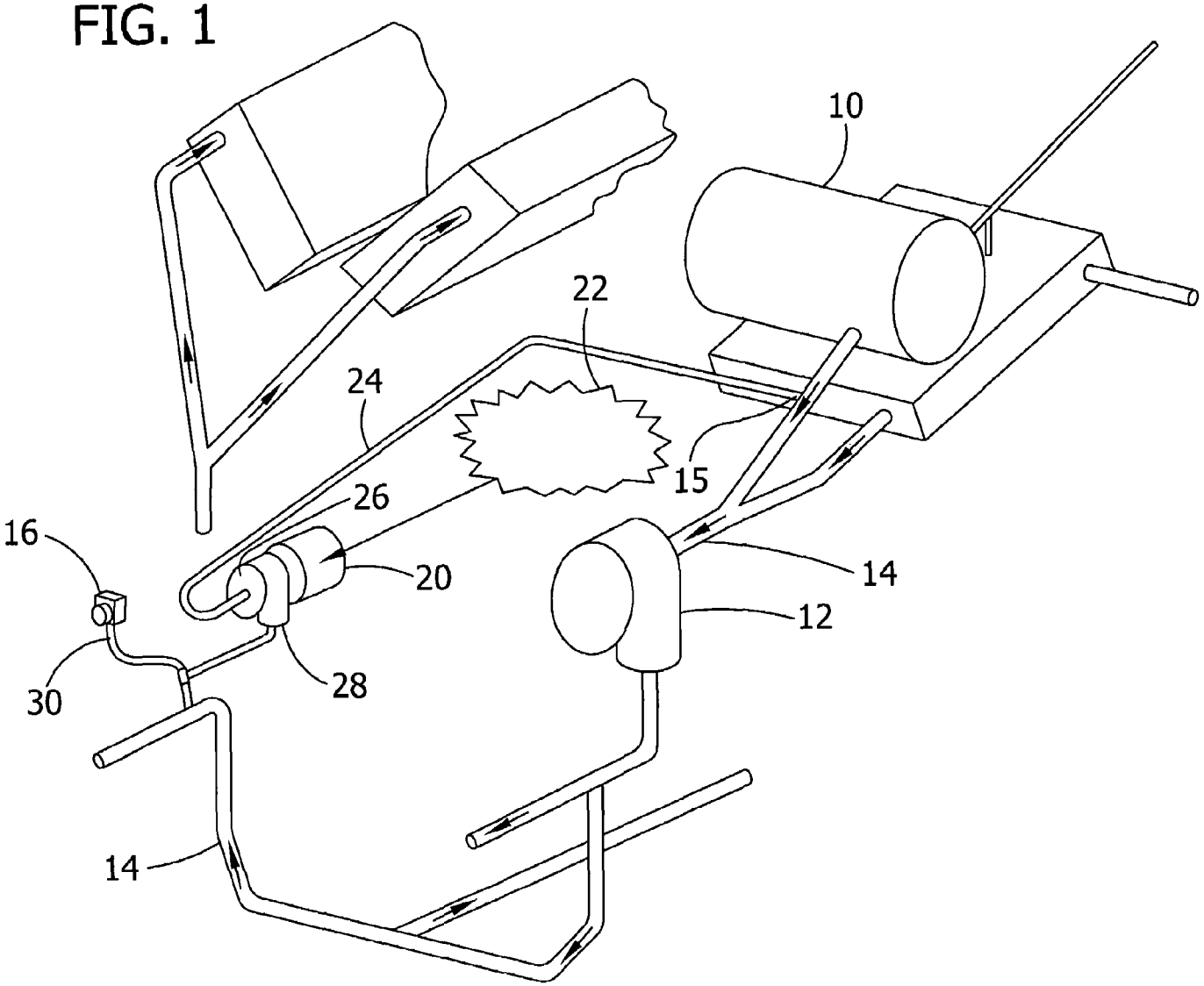
FIG. 1 is a schematic perspective view of the engine cooling system of an EMD engine with an AESS system and components including the preferred embodiment of the present invention.

As illustrated in FIG. 1, during operation of the EMD engine (not shown) water is supplied to the engine from a water source such as water tank 10 through an engine water pump 12 and water supply line 14. A low water pressure sensing device 16 is in communication with the water supply line 14 connected to the engine to detect a low water condition. As discussed more fully below, if a low water condition that could be harmful to the engine is detected, the engine is shut down. In one preferred embodiment of the present invention, connected to the water supply line and in communication with the low water pressure sensing device 16 is a water assist pump 20. The water assist pump 20 is an electric pump controlled by the automatic engine start/stop (AESS) system computerized controller 22. When activated, the pump 20 draws water from the water supply line 14, such as at connection 15 coming from the water supply tank 10, and through line 24 connected to the inlet 26 of the pump 20. Water is then discharged from outlet 28 of pump 20 into the low water pressure sensing device supply line 30 as described in more detail below.

Figure 2:
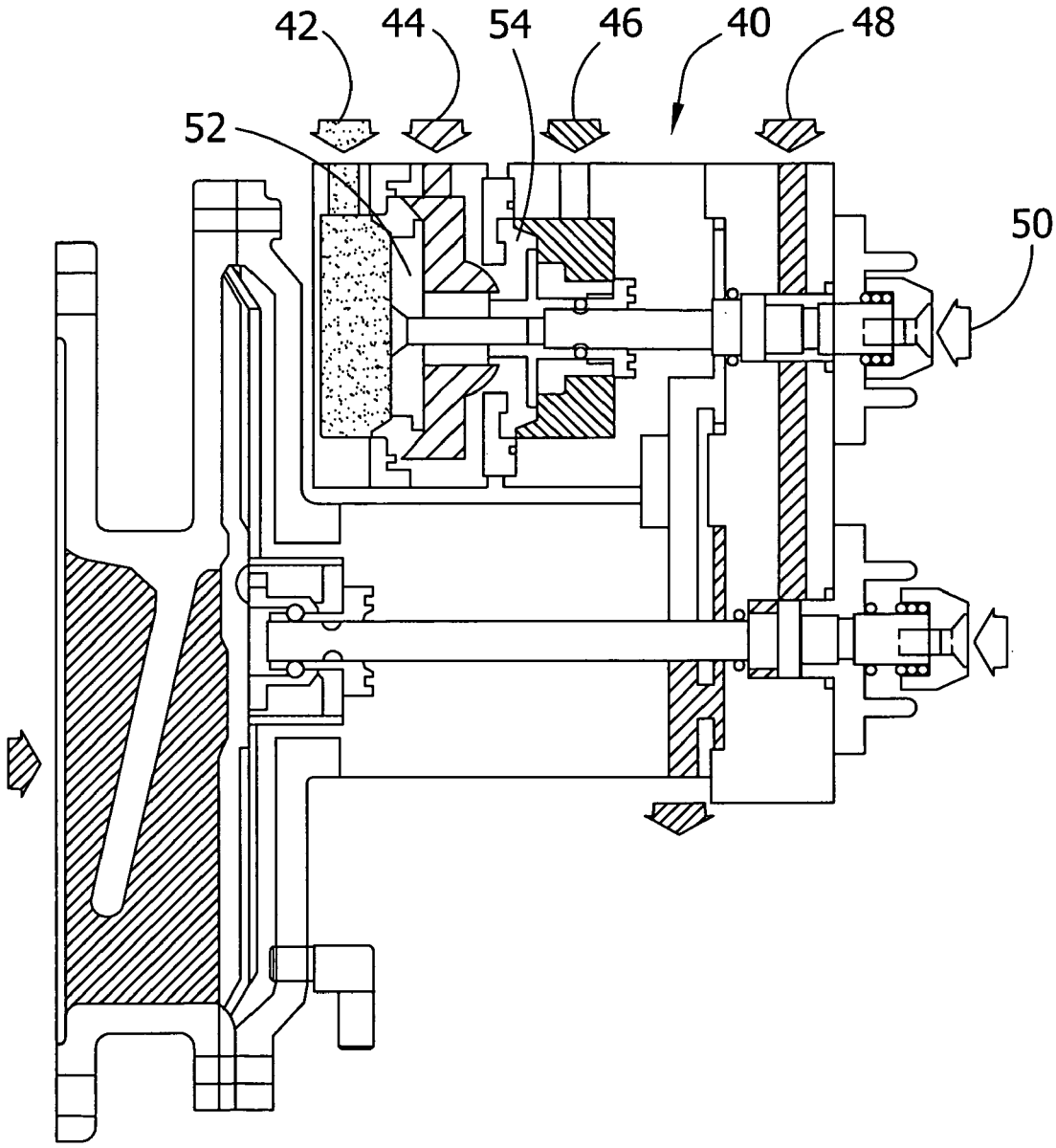
FIG. 2 is a schematic view of a positive crankcase pressure condition in an EMD engine.

Referring now to FIG. 2, a schematic representation of an EMD low water protective device is shown generally at 40. Such an EMD protective device 40 is included in many locomotives equipped with EMD engines. The engine water pump discharge pressure is supplied at 42; the engine water pump inlet pressure is supplied at 44; the engine air box pressure is supplied at 46 and the oil inlet from the governor is at 48. An oil relief valve 50 is shown in the latched position in FIG. 2 and in an unlatched position or tripped position in FIG. 3. A first diaphragm 52 is positioned between the water pump discharge pressure 42 and the engine water pump inlet pressure 44. A second diaphragm 54 is positioned on a side of the air box pressure, and the two diaphragms are interconnected such that a predetermined imbalance in the water pump pressure across the first diaphragm 52 causes the oil relief valve 50 to unlatch.

Figure 3:
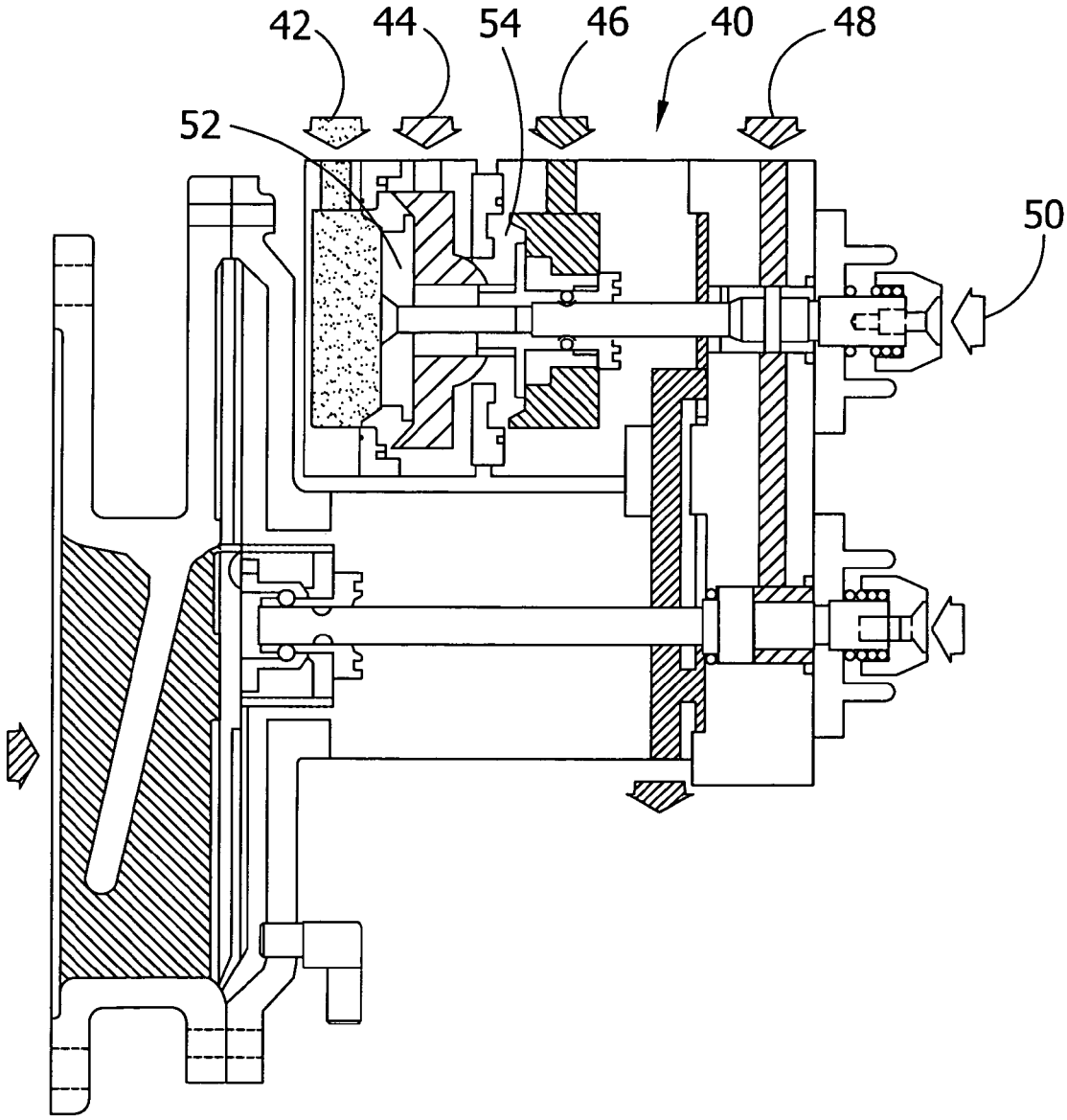
FIG. 3 is a schematic view of a low differential water pressure condition.

During standard operation of the low water protective device, when the differential pressure across the engine water pump 12 becomes less than the air box pressure the oil relief valve 50 is tripped as shown in FIG. 3, causing the oil drain valve to open and dump engine oil from the low oil sensing device of the engine governor (not shown). The governor senses low oil pressure and initiates low oil shut down of the engine.

When, in one embodiment with the present invention, the water assist pump 20 is activated it adds water pressure to the engine water pump discharge pressure at 42 preventing it from falling sufficiently that the pressure differential across diaphragm 52 falls below the air box pressure thus preventing the low water detection device from triggering and shutting down the engine.

Generally speaking, when the AESS controller 22 activates the automatic start procedure it rings a warning bell 60 for 30 seconds and completes the circuit from the battery to the water assist pump 20 which causes pump 20 to pump cooling water and pressurize the cooling system. The priming period lasts for 15 to 20 seconds. The engine cranking procedure then occurs.

In accordance with AESS procedure the engine will crank for not more than 20 seconds. If the engine has started within that time period the AESS system will de-energize the water assist pump 20. In a case when the engine did not start the AESS system will de-energize the water assist pump 20 and repeat the starting procedure in 2 minutes.

Figure 4:
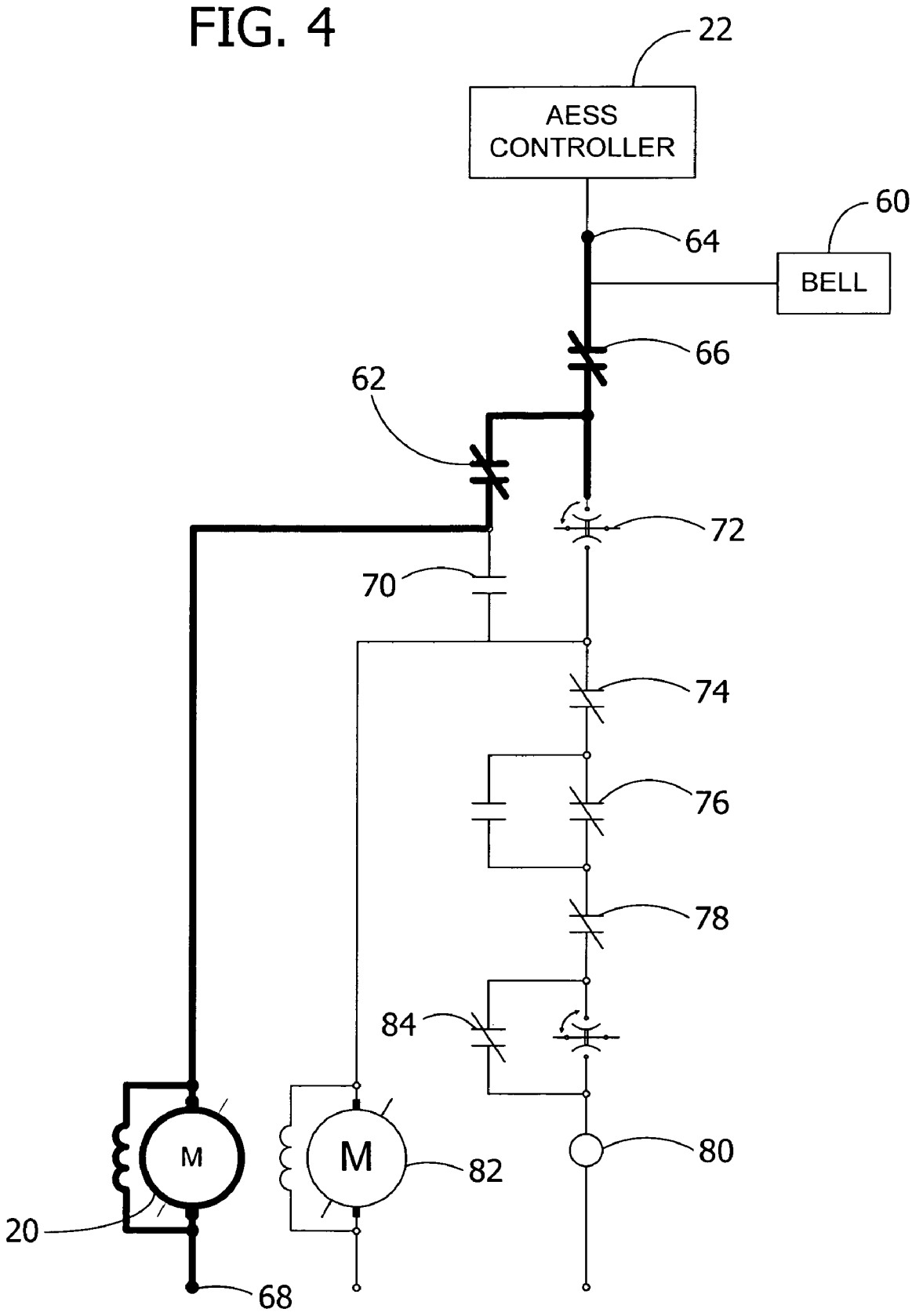
FIG. 4 is a schematic of activation of the system of FIG. 1 during engine priming mode.
Figure 5:
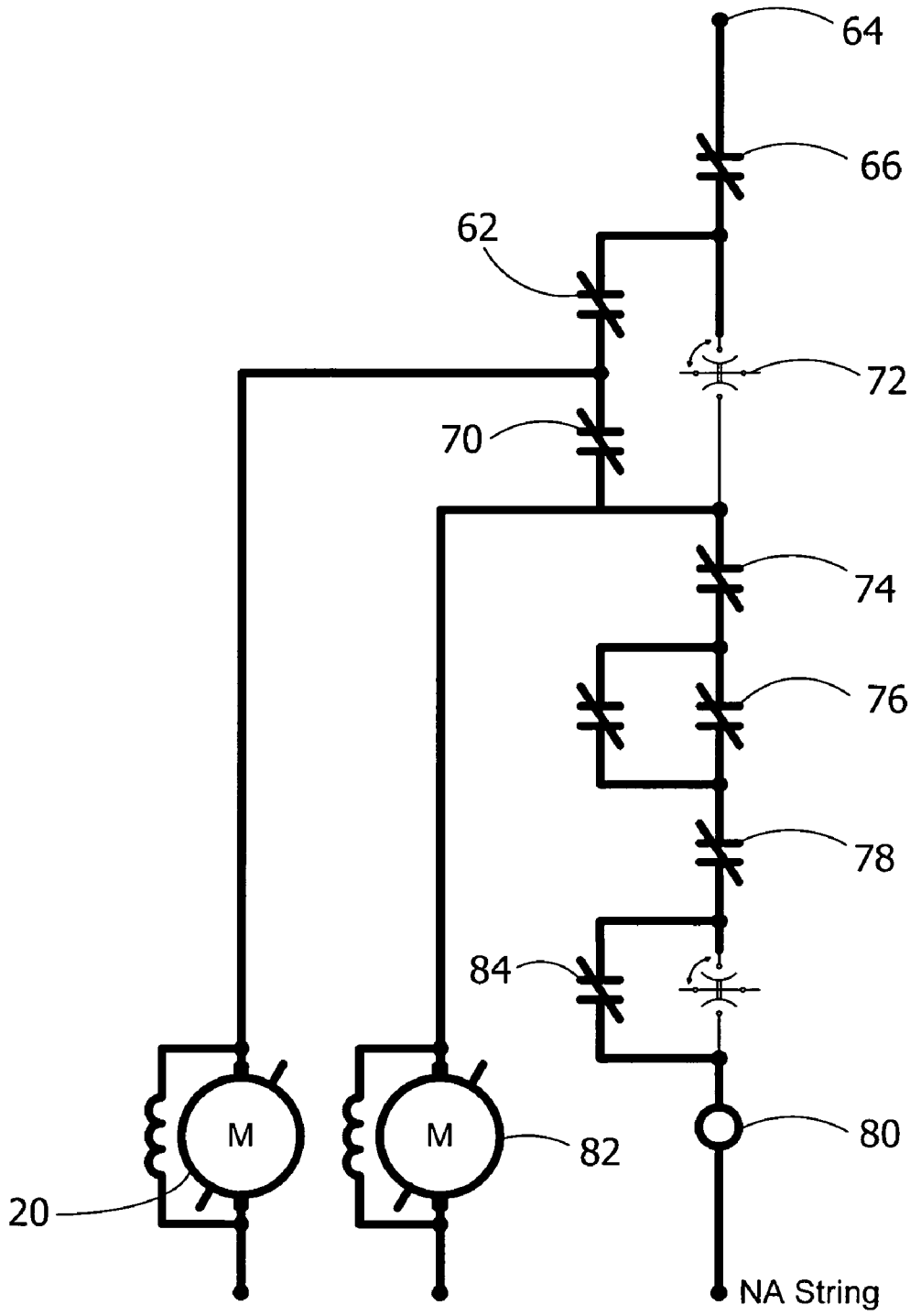
FIG. 5 is a schematic of activation of the system of FIG. 1 during engine cranking mode.

Referring now to FIGS. 4 and 5, although the electrical connections for the water assist pump 20 can be done in many ways, these figures and the below disclosure illustrate one such connection system as an example only. When the AESS controller 22 activates the automatic engine start procedure it energizes Engine Start Relay 62, and thus complete the circuit to water assist pump 20 from the battery switch via Local Control circuit breaker 64, normally closed interlock of No Voltage Relay 66 and interlock of Engine Start Relay 62 and then returning to the Local Control circuit Breaker 68 and Battery Switch.

The priming period, as shown in FIG. 5, lasts for 15 to 20 seconds. The engine cranking procedure then occurs as shown in FIG. 5. During this procedure Engine Start Relay 70 is activated in addition to Engine Start Relay 62. Interlocks of Engine start Relays 62 and 70 bypass a manual switch 72 and via interlocks of a Thermal Overload Relay 74, Fuel Pump Relay 76 and second normally closed interlock of relay 78 energize Starting Auxiliary Contactor 80. At the same time, Governor Assist Pump 82 is activated. The cranking lasts for 15 to 20 seconds. If the engine start was successful the relay 78 will pick up and open the circuit to the Water Assist Pump, the Governor Assist Pump 82 and the Starting Auxiliary Contactor 80 and AESS will de-energize Engine Start Relays 62 and 70 and Crank Setup Relay 84. If the engine did not start AESS controller will de-energize Engine Start Relays 62 and 70 and repeat the starting procedure in 2 minutes.

In accordance with AESS procedure, the engine will crank for not more than 20 seconds. If the engine has started within that time period the AESS system will de-energize Engine Start Relays 62 and 70 and Crank Setup Relay 84.

Figure 6:
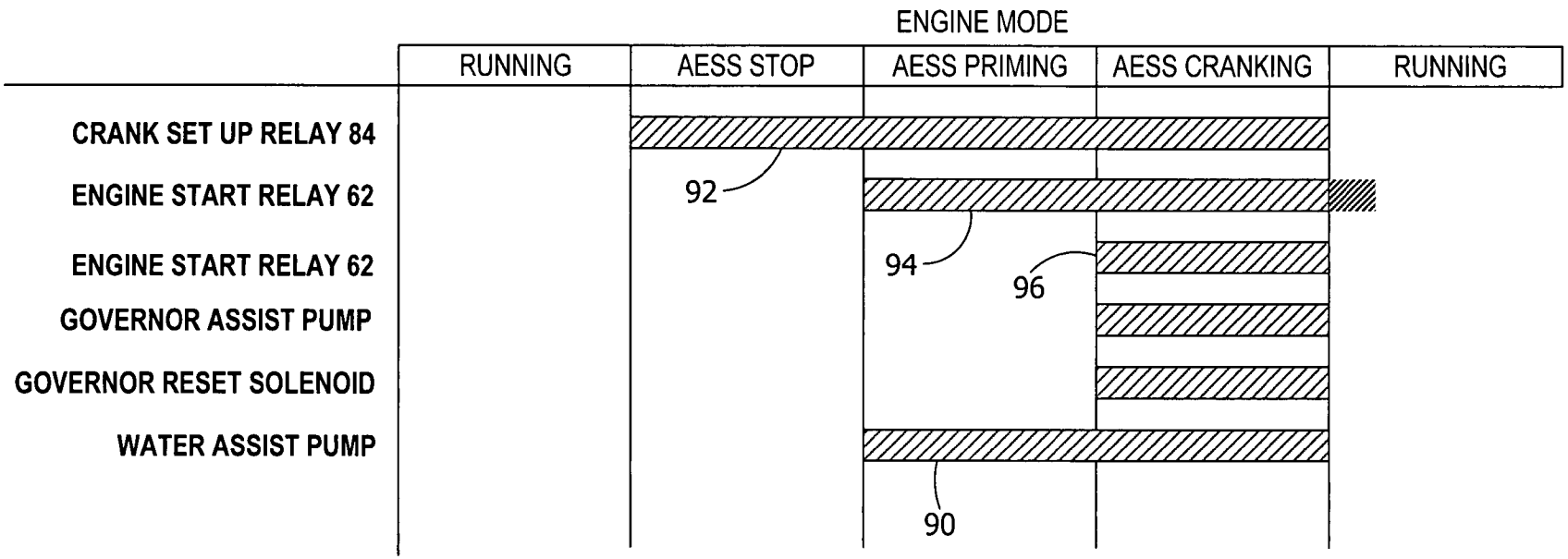
FIG. 6 is a timing chart for energizing and de-energizing various components of the system.

The above sequencing is shown in bar graph form in FIG. 6 to provide a better understanding of when the various components are activated and not activated. As shown in FIG. 6 by bar 90, the water assist pump 20 is preferably activated during priming of the engine as well as during cranking. This allows the pressure to be developed in the low water pressure protective device 40 early in the starting process. As shown by bar 92 the Crank Setup Relay 84 is activated when the AESS system is stopped-as well as during the AESS priming period and the AESS cranking period. The Engine Start Relay 62 is engaged during AESS priming and cranking, as shown by bar 94, and Engine Start Relay 70 is engaged only during the cranking period, as shown by bar 96.

When introducing elements or features of the present invention or the preferred embodiment(s) thereof, the articles "a", "an", "the" and "said" are intended to mean that there are one or more such elements or features. The terms "comprising", "including" and "having" are intended to be inclusive and mean that there may be additional elements or features other than those listed.

As various changes could be made in the above embodiments without departing from the scope of the invention, it is intended that all matter contained in the above description or shown in the accompanying drawings shall be interpreted as illustrative and not in a limiting sense.

What is claimed is:

1. A system for overriding an engine protective device which includes a low water pressure sensing device in communication with the engine cooling system for shutting down the engine when low water pressure in the engine is sensed, the override system comprising:

a water assist pump connected to a source of water and communicating with the protective device for supplying pressurized water to the low water pressure sensing device to maintain relatively high water pressure to prevent the device from shutting down the engine; and a controller for activating the water assist pump during start up of the engine.

2. The system of claim 1 used in conjunction with an automatic engine start/stop system (AESS).

3. The system of claim 1 wherein the water assist pump is an electrically driven pump.

4. The system of claim 1 wherein the controller operates the water assist pump during priming and cranking of the engine.

5. The system of claim 4 used in conjunction with an automatic engine start/stop system (AESS).

6. A system for overriding an engine protective device which includes first and second interconnected diaphragms, one side of the first diaphragm in communication with a discharge from an engine water pump and an opposite side of the first diaphragm in communication with an inlet of the engine water pump and a first side of the second diaphragm in communication with an engine air box such that the diaphragms are moved by differential pressure across the diaphragms when the force on the first diaphragm due to differential pressure across the first diaphragm becomes less than the force on the second diaphragm applied by the pressure of the engine's air pressure box acting on the second diaphragm, indicating low water pressure in a cooling system of an engine, the override system comprising:

a water assist pump connected to a source of water and communicating with the protective device for supplying pressurized water to the one side of the first diaphragm in the engine protective device; and a controller for activating the water assist pump during start up of the engine.

7. The system of claim 6 used in conjunction with an automatic engine start/stop system (AESS).

8. The system of claim 6 wherein the water assist pump is an electrically driven pump.

9. The system of claim 6 wherein the controller operates the water assist pump during priming and cranking of the engine.

10. The system of claim 9 used in conjunction with an automatic engine start/stop system (AESS).

* * * * *